US006214141B1

(12) United States Patent
Kim et al.

(10) Patent No.: US 6,214,141 B1
(45) Date of Patent: Apr. 10, 2001

(54) DECORATIVE FLOCKING TECHNIQUES

(76) Inventors: John Chinung Kim, 311 Pine Ridge Dr., Bloomfield Hills, MI (US) 48304; John Kim, II, 4144 Woodcreek, Ypsilanti, MI (US) 48197

( * ) Notice: Subject to any disclaimer, the term of this patent is extended or adjusted under 35 U.S.C. 154(b) by 0 days.

(21) Appl. No.: 09/184,818

(22) Filed: Nov. 2, 1998

(51) Int. Cl.[7] ..... B05D 1/14; B05D 1/16

(52) U.S. Cl. ..... 156/72; 156/82; 156/279; 427/206

(58) Field of Search ..... 156/72, 82, 279; 427/180, 200, 206; 446/319, 372, 394; 132/53, 56; 428/16

(56) References Cited

U.S. PATENT DOCUMENTS 3,436,245 * 4/1969 Grundman .
3,917,883 * 11/1975 Jepson .
4,108,956 * 4/1977 Casey .
4,110,138 * 8/1978 Nomura et al. .
4,668,323 * 5/1987 Lenards et al. .
5,047,103 * 9/1991 Abrams et al. .
5,263,233 11/1993 Kim et al. ..... 24/295
5,510,143 * 4/1996 Walsh et al. .

FOREIGN PATENT DOCUMENTS

03288638 * 12/1991 (JP) .

* cited by examiner

*Primary Examiner*—Michael W. Ball
*Assistant Examiner*—John T. Haran
(74) *Attorney, Agent, or Firm*—Gifford, Krass, Groh, Sprinkle, Anderson & Citkowski, PC

(57) ABSTRACT

A method of flocking a surface, and treating the flocking, achieves a decorative effect when applied to toys where the invention may be used to simulate different types of human and animal hair and fur. After applying an adhesive to a surface to be flocked, a group of flocking particles are directed onto the surface, and the result is modified using alternative techniques to achieve the desired effect. In one embodiment, the particles are in the form of fibers which "ball up" upon the application of heat, and the outwardly exposed ends of the particles are flame-treated to create a kinky appearance. Nylon fibers are suitable in this case. In an alternative embodiment, an adhesive is applied to the flocking particles attached to the surface, and additional flocking particles are applied to the adhesive-coated fibers. As further alternative embodiment, air pressure is applied to the particles before the adhesive cures, so that the particles assume a preferred orientation with respect to the surface. In all cases, two groups of particles are preferably directed toward and onto the surface before the adhesive cures so as to fill in gaps following the initial application. Preferably, the first group of flocking particles are electrostatically directed onto the surface, whereas second group of flocking particles are pneumatically applied.

28 Claims, 1 Drawing Sheet

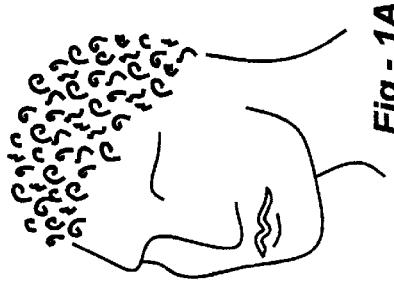
Fig - 1A
Fig - 1B
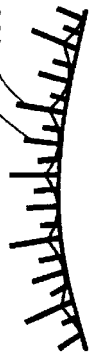
Fig - 1C
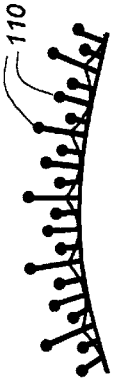
Fig - 1D
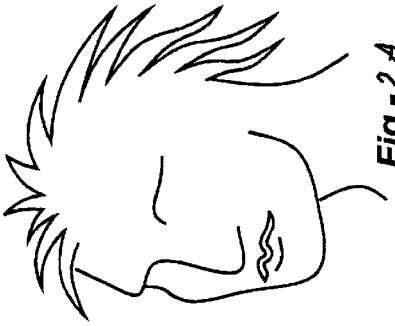
Fig - 2A
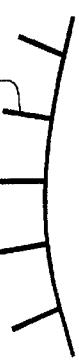
Fig - 2B
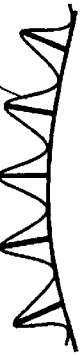
Fig - 2C
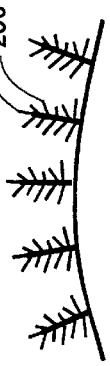
Fig - 2D
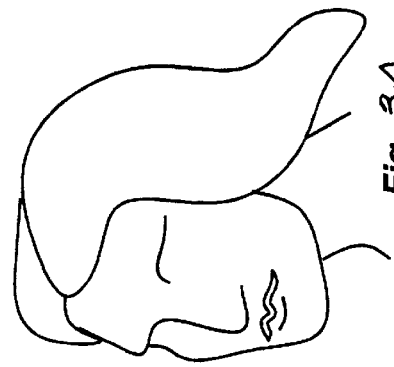
Fig - 3A
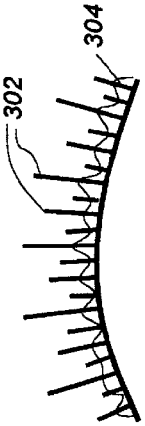
Fig - 3B
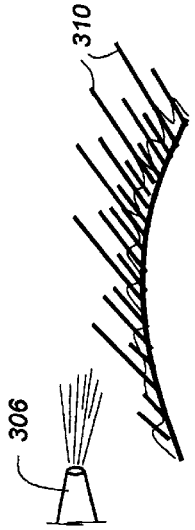
Fig - 3C

DECORATIVE FLOCKING TECHNIQUES

FIELD OF THE INVENTION

This invention relates generally to flocking, fiber-coatings and the like and, in particular, to methods of applying and modifying flocked surfaces to achieve a decorative effect, particularly with respect to toys such as dolls and other applications.

BACKGROUND OF THE INVENTION

Flocking has been used for a surprisingly long time to give surfaces a velvet-like texture and appearance. The techniques dates back several decades, and has been used for many years in conjunction with selective application on wallpaper and other surfaces.

Typically, an area to be flocked is coated with an adhesive or glue, and the flocking particles, usually in the form of small elongated fibers, are blown onto the surface, where they become attached. When the glue dries, depending upon the length and composition of the fibers, a soft or fuzzy texture and/or appearance will be result.

Modernly, flocked surfaces are used in a wide variety of applications, including compartment linings in automobiles and other vehicles, where the affect is not only attractive, but also minimizes vibrational noise due to rattling of compartment contents. It is typical, for example, to use flocking in between-seat consoles, and the like, where cassettes tapes and CDs are stored. Flockings are also commonly added to textile substrates for use in clothing, upholstery covers, and packaging.

Other applications of the process have been more limited, since the usual steps to achieve a velvet-like touch and appearance are only suitable to certain types of uses. With respect to toys such as dolls, for example, flocking has been used to simulate hair, but due to limitations in the process, has been relegated to a short, fuzzy presentation, which is predictable if not unappealing. The need remains, therefore, for modifications to the application of flocking so as to achieve a greater range of desired visual and/or textural affects, so as to simulate the feel of natural hair.

SUMMARY OF THE INVENTION

The present invention resides in a method of flocking a surface, and treating the flocking, so as to achieve a decorative effect. The various steps are suited to toys such as dolls in particular, where the treated flocking may be used to simulate different types of hair and hair styles.

Broadly, the method includes the steps of applying an adhesive to a surface to be flocked, directing a group of flocking particles onto the surface, and treating the result using alternative techniques to achieve a desired effect. In one embodiment, the particles are in the form of fibers which "ball up" upon the application of heat, and the outwardly exposed ends of the particles are flame-treated to create a kinky appearance. Nylon fibers are suitable in this case.

In an alternative embodiment, an adhesive is applied to the flocking particles attached to the surface, and additional flocking particles are applied to the adhesive-coated fibers. If the length of the additional flocking particles is substantially shorter than the length of the flocking particles of the first group, a shag-type surface appearance is realized.

According to yet a further alternative embodiment, air pressure is applied to the particles before the adhesive cures, so that the particles assume a preferred orientation with respect to the surface. Using the doll application once again, this approach achieves a laid-down hair style which is quite stable upon curing of the adhesive.

In all cases, two groups of particles having different fiber lengths are preferably directed toward and onto the surface before the adhesive cures so as to fill in gaps following the initial application. Preferably, the first group of flocking particles are electrostatically directed onto the surface, whereas the second group of flocking particles are pneumatically applied. Through the use of variable flock length, fiber type, denier and processing steps according to the invention, a wide range of natural hair styles and other effects may be simulated.

BRIEF DESCRIPTION OF THE DRAWINGS

FIG. 1 is a drawing which illustrates a first embodiment of the invention used to create a kinky hair appearance; and, in particular:

FIG. 1A illustrates, from an oblique perspective, a doll having hair produced in this manner;

FIG. 1B is a high simplified side view drawing of a first application of flocking fibers;

FIG. 1C illustrates how the first application of fibers may be supplemented with a second group of fibers to fill in gaps and provide certain desired textural effects;

FIG. 1D shows how, through the use of flame treating, the ends of the fibers will ball up through the application of heat to create a desired affect;

FIG. 2 illustrates an alternative embodiment of the invention used to create a shag-type look/appearance and, more particularly:

FIG. 2A illustrates how this shag-type appearance is applicable to doll hair;

FIG. 2B illustrates in simplified fashion a first application of relatively long flocking fibers to a surface;

FIG. 2C illustrates how these initial fibers are subsequently coated with an adhesive;

FIG. 2D shows how a second application of preferably shorter flocking particles are directed onto the adhesive first group of particles to create this desired affect;

FIG. 3 illustrates yet a further alternative of the embodiment of the invention wherein a longer hairstyle or other affect may be produced and, in particular, FIG. 3A illustrates how this embodiment might appear in a typical application;

FIG. 3B illustrates how longer flocking fibers are applied according to this aspect of the invention;

FIG. 3C illustrates the fibers may be caused to lie down through the use of a pneumatic spray.

DETAILED DESCRIPTION OF THE INVENTION

Now making reference to the figures, the drawings show embodiments of the invention, and endeavor to illustrate important steps in carrying out different aspects of the method to achieve desired affects. In particular, the drawings associated with FIG. 1 depict an embodiment of the invention used to create a flocked surface having a kinky appearance suitable for dolls having that hairstyle, FIG. 2 illustrates the appearance and steps used to achieve a shag-type look, and FIG. 3 illustrates how a pneumatic jet of air may be used to style flocking fibers for a more layed-down look. Although these descriptions utilize the example of doll hair, the invention is not limited in this respect. Indeed, the steps of each embodiment of the method may be applied to a wide variety of flat and curved surfaces to achieve a range of effects depending upon the type of adhesive and length and composition of the flocking particles. For example, in addition to human hair, simulated animal hair is also possible, including horse hair, dog and cat fur, etc.

FIG. 1A illustrates a doll head having a hair style exhibiting what might be considered a short nappy look according to the invention. The area to be flocked is first masked off, if desired, and a suitable glue or adhesive applied, preferably in spray form. The flocking particles, typically in fiber form, are then electrostatically and/or pneumatically applied. Use of an electrostatic application is more conducive to an on-end adhering of the fibers, as shown in FIG. 1B. Electrostatic charge levels on the order of 50–80 kVa are suitable for use in conjunction with a pneumatic feed rate of about 30 and an air pressure of from 10 to 60 psi using a K-Omega pneumatic flocking machine.

Although the base material itself is not electrically conductive, certain adhesives exhibit a slight electrical conductivity such that when a electrode is placed on the surface a slight (negative) charge is achieved. The charge on the flocking particles tends to build up at the tip of the fiber, and since the fibers are cylindrical in nature they become dipoles, causing them to turn around in the air and lodge on-end in the adhesive-coated surface. Having treated surface areas which are easily accessed through electrostatic application, so gaps may remain. If the glue remains tacky, the part is delivered to a pneumatic station where a second group of particles, preferably variable in terms of length and denier, are blown in to essentially fill in the gaps. Since the fibers that were applied electrostatically are embedded perpendicularly with respect to the surface, the additional, pneumatically applied particles oriented themselves along side the first grouping of fibers, as shown in FIG. 1C.

Using a water-based adhesive, the product is cured in an oven at 180° F. for approximately 20 minutes, then allowed to cool down. As illustrated in FIG. 1D, the fibers are flame treated to lightly singe the exposed ends of the fibers, causing them to curl down or "ball-up." A commercially available nylon fiber having 3 to 24 denier thickness and 0.040-inch to 0.250-inch length has been found suitable for doll-hair applications. Masking may also be used to avoid heat-treating areas that may be damaged by the flame.

Now turning to FIG. 2, FIG. 2A illustrates how a longer, kinkier or shag-type appearance may be achieved using the invention. The starting fibers are on the order of 10 times longer than those used in the process of FIG. 1. Again, a first group of particles are preferably applied electrostatically, followed by a pneumatic gap-filling application preferably using smaller fibers (not shown).

The adhesive is cured, but then a second application of adhesive is used to at least partially coat the already attached fibers as shown in FIG. 2C. Following this, a second (or third) group of particles, preferably shorter fibers, are attached pneumatically, as shown in FIG. 2D. Masking may be used where appropriate to limit adhesive and/or particle application. The result is a Christmas-tree appearance, with the shorter fibers glued to the longer fibers. It has been found that shorter fibers on the order of 0.20–0.30 inches in length at 1.8 denier work well with base fibers of 3.0 denier.

Now turning to FIG. 3, FIG. 3A illustrates from an oblique perspective a method of achieving rather densely packed fine straight hairs which actually lie down onto the surface as opposed to being perpendicular. According to this aspect of the invention, an initial group of particle fibers is electrostatically applied with a supplemental pneumatic application being used to fill in the gaps. While the adhesive has not yet cured, a gentle air spray of, for example, 5 to 20 psi, is directed at the crown of the head, in the case of a doll product, or in any other desired orientation, causing the fibers to lie down or assume some other form relative to the surface. The result is then cured and cleaned by blowing out loose fibers. Conveniently, the final product may be covered and/or shipped in a plastic bag which is preferably wrapped tightly around the head of the doll so that the matted fibers cure with a desired orientation.

What is claimed is:

1. A method of flocking a surface and treating the flocking to achieve a decorative effect, comprising the steps of:

applying an adhesive to a surface to be flocked;

directing a first group of flocking particles onto the surface; and directing a second group of flocking particles onto the surface before the adhesive has cured to fill in gaps that remain through the application of the first group of flocking particles, the flocking particles in the second group being dissimilar from the flocking particles in the first group.

2. The method of claim 1, wherein:

at least some of the flocking particles are in the form of elongated fibers having two ends, including a first end oriented toward the surface and a second end which is outwardly exposed; and the method includes the additional step of flame-treating the outwardly exposed ends of at least some of the fibers.

3. The method of claim 1, wherein:

the flocking particles are in the form of elongated fibers having a length dimension; and the length of flocking particles of the first group is substantially longer than the length of the flocking particles of the second group.

4. The method of claim 1, further including the steps of:

applying an adhesive to the flocldng particles attached to the surface; and directing a third group of flocking particles onto the particles receiving the adhesive.

5. The method of claim 4, wherein:

the flocking particles are in the form of elongated fibers having a length dimension; and the length of flocking particles of the third group is substantially shorter than the length of the flocking particles of the first group.

6. The method of claim 1, further including the step of:

applying air pressure to at least some of the particles before the adhesive cures so that the particles assume a preferred orientation with respect to the surface when the adhesive does cure.

7. The method of claim 1 wherein at least one of the groups of flocking particles is nylon.

8. The method of claim 1 wherein:

the step of directing a first group of flocking particles onto the surface includes the step of electrostatically directing the particles onto the surface; and the step of directing a second group of flocking particles onto the surface includes the step of pneumatically directing the particles onto the surface.

9. The method of claim 1, wherein the surface forms part of a doll.

10. The method of claim 1, further including the step of masking a portion of the surface prior to the step of applying the adhesive.

11. A method of flocking a surface and treating the flocking to achieve a decorative effect, comprising the steps of:

applying an adhesive to a surface to be flocked, wherein the surface comprises part of a toy;

providing flocking particles in the form of fibers having first and second ends;

directing the particles onto the surface such that the first ends are oriented toward the surface and the second ends are outwardly exposed; and flame-treating the outwardly exposed ends of at least some of the flocking particles.

12. The method of claim 11, wherein at least one of the groups of flocking particles is nylon.

13. The method of claim 11, wherein the toy is a doll.

14. The method of claim 11, further including the step of:

directing a second group of flocking particles onto the surface before the adhesive has cured to fill in gaps that remain through the application of the first group of flocking particles.

15. The method of claim 14, wherein:

the flocking particles in the second group are in the form of elongated fibers having a length dimension; and the length of flocking particles of the first group is substantially longer than the length of the flocking particles of the second group.

16. The method of claim 11, further including the steps of:

applying an adhesive to the flocking particles attached to the surface; and directing an additional group of flocking particles onto the particles receiving the adhesive.

17. The method of claim 16, wherein:

the flocking particles in the additional group are in the form of elongated fibers having a length a dimension; and the length of flocking particles of the additional group is substantially shorter than the length of the flocking particles of the first group.

18. The method of claim 11, further including the step of:

applying air pressure to at least some of the particles before the adhesive cures so that the particles assume a preferred orientation with respect to the surface when the adhesive does cure.

19. The method of claim 11, further including the step of masking a portion of the surface prior to the step of applying the adhesive.

20. A method of flocking a surface and treating the flocking to achieve a decorative effect, comprising the steps of:

applying an adhesive to a surface to be flocked, wherein the surface comprises part of a toy;

directing a first group of flocking particles onto the surface;

applying an adhesive to the flocking particles attached to the surface; and directing a second group of flocking particles onto the particles receiving the adhesives;

wherein the flocking particles are in the form of elongated fibers having a length dimension; and the length of flocking particles of the second group is substantially shorter an the length of the flocking articles of the first group.

21. The method of claim 20, wherein the toy is a doll.

22. The method of claim 20, wherein:

the flocking particles include a first end oriented toward the surface and a second end which is outwardly exposed; and the method includes the additional step of flame-treating the outwardly exposed ends of at least some of the fibers.

23. The method of claim 20, further including the steps of:

applying an adhesive to the flocking particles attached to the surface; and directing a third group of flocking particles onto the particles receiving the adhesive.

24. The method of claim 23, wherein:

the flocking particles in third group are in the form of elongated fibers having a length dimension; and the length of flocking particles of the third group is substantially shorter than the length of then flocking particles of the first group.

25. The method of claim 20, further including the step of:

applying air pressure to at least some of the particles before the adhesive cures so that the particles assume a preferred orientation with respect to the surface when the adhesive does cure.

26. The method of claim 20, wherein at least one of the groups of flocking particles is nylon.

27. The method of claim 20 wherein:

the step of directing a first group of flocking particles onto the surface includes the step of electrostatically directing the particles onto the surface; and the step of directing a second group of flocking particles onto the surface includes the step of pneumatically directing the particles onto the surface.

28. The method of claim 20, further including the step of masking a portion of the surface prior to the step of applying the adhesive.

* * * * *